United States Patent [19]

Uchida

[11] Patent Number: 4,695,259

[45] Date of Patent: Sep. 22, 1987

[54] WATERPROOF LAMP SOCKET CONSTRUCTION

[75] Inventor: Kihachirou Uchida, Shimizu, Japan

[73] Assignee: Koito Seisakusho Co., Ltd., Tokyo, Japan

[21] Appl. No.: 779,642

[22] Filed: Sep. 24, 1985

[30] Foreign Application Priority Data

Sep. 26, 1984 [JP] Japan ..... 59-145359[U]

[51] Int. Cl.[4] ..... H01R 13/52

[52] U.S. Cl. ..... 439/271

[58] Field of Search ..... 339/17 D, 90 F, 94 L, 339/181 R, 181 C, 182 R, 187, 188 R, 188 C, 189 L, 135 R, 102 L; 177/86, 87, 152, 153, 207 R, 213

[56] References Cited

U.S. PATENT DOCUMENTS

| | | | |
|---|---|---|---|
| 2,167,756 | 8/1939 | Hobbs | 339/181 R X |
| 2,321,510 | 6/1943 | Paquette | 339/181 R X |
| 2,683,258 | 7/1954 | Churchill | 339/94 |
| 2,705,308 | 3/1955 | Howard | 339/94 |
| 3,170,751 | 2/1965 | Heller | 339/188 |
| 3,477,061 | 11/1969 | Stephenson | 339/94 M X |
| 3,594,696 | 7/1971 | Witek | 339/94 M X |
| 3,649,955 | 3/1972 | Schmidt et al. | 339/94 A X |
| 4,055,205 | 10/1977 | Withoff et al. | 277/152 X |
| 4,162,116 | 7/1979 | Lehmann | 339/94 M X |
| 4,304,416 | 12/1981 | Oshima | 277/152 X |
| 4,417,736 | 11/1983 | Herrmann | 339/94 M X |
| 4,482,161 | 11/1984 | Izzi | 277/207 A |

*Primary Examiner*—Eugene F. Desmond

*Attorney, Agent, or Firm*—Browdy and Neimark

[57] ABSTRACT

A waterproof socket construction suitable for use in connecting an electric bulb to a lamp body therethrough on a motor vehicle. Included is a socket body having defined therethrough an axial hollow comprising a larger diameter portion extending rearwardly from the front end of the socket body and a smaller diameter portion adjacent the rear end of the socket body. A tubular, metal made ferrule is received in the larger diameter portion of the hollow and is locked against displacement relative to the socket body. An insulating plate having a foot contact thereon is mounted within the ferrule for axial sliding motion within limits. A cylindrical packing of elastic material is closely engaged in the smaller diameter portion of the hollow in the socket body for watertightly closing its rear end. The packing has a flange on its front end thereof held against the annular shoulder between the larger and smaller diameter portions of the socket body hollow. Disposed between the insulating plate and the packing so as to permit rearward displacement of the former relative to the ferrule, a spring forces the flange of the packing against the annular shoulder of the socket body for the establishment of watertight contact therebetween.

4 Claims, 4 Drawing Figures

WATERPROOF LAMP SOCKET CONSTRUCTION

BACKGROUND OF THE INVENTION

This invention is generally in the field of electric lamp assemblies, and particularly in that of socket structures for mechanical and electrical engagement with bulbs. More particularly, the invention pertains to a waterproof socket construction for use on motor vehicles or the like.

Automotive lamp assemblies have been known and used extensively wherein the bulb is removably mounted to a lamp body via a socket structure. Being wholly or nearly exposed to the atmosphere, the socket structure for automotive use must be impervious to water.

A typical conventional lamp socket construction for automotive use comprises a molded plastic body having a hollow extending axially therethrough, with the diameter of the hollow being reduced in two steps to provide two annular shoulders disposed adjacent the rear end of the socket body and directed forwardly thereof. Snugly received in the larger diameter portion of the hollow is a tubular, metal ferrule having its rear end bent inwardly and further rearwardly for abutting engagement with the internal annular shoulders of the socket body. The ferrule has mounted therein an insulating disk carrying a foot contact electrically connected to a cable extending rearwardly therefrom through a rubber packing closing the rear end of the socket body. This packing has a flange on its front end to engage the inwardly bent rear end portion of the ferrule, a tapered rear end portion protruding rearwardly of the socket body, and an annular groove intermediate its axial ends for receiving the rearwardly bent portion of the ferrule.

According to this prior art socket construction, the rubber packing is in direct engagement with the metal ferrule. The packing requires the annular groove for engagement with the ferrule, while the latter must have its rear end portion bent inwardly and further rearwardly for engagement with the packing. Consequently, the fabrication of both rubber packing and metal ferrule requires complex equipment. During the assemblage of the socket, too, the proper interengagement of the packing and ferrule necessitates a troublesome and time consuming procedure, adding to the manufacturing cost of the socket.

As an additional shortcoming of the noted conventional socket construction, the ferrule which forms part of a path for electric current has its rear end portion protruding into the reduced diameter portion of the hollow in the socket body and so is not sufficiently protected from water by the packing. Still further, being mostly engaged with the ferrule, the packing has made rather poor watertight contact with the socket body. These weaknesses have so far been compensated for by applying a sealant such as that of a hotmelt composition to the rear end of the socket body so as to seal its joint with the packing. This conventional solution is of course unsatisfactory because of the additional step of assemblage required. The packing itself has so far served little purpose for waterproofing the socket; rather, it has added to its manufacturing cost.

SUMMARY OF THE INVENTION

The present invention overcomes the above drawbacks of the prior art and provides an improved waterproof socket construction comprised of component parts that are easier to fabricate and assemble than heretofore.

Stated in brief, the waterproof lamp socket construction in accordance with the invention comprises a socket body having a hollow extending axially therethrough, the hollow including a larger diameter portion extending rearwardly from a front end of the socket body and a smaller diameter portion adjacent a rear end of the socket body, with an annular shoulder defined between the larger and smaller diameter portions of the hollow. A tubular ferrule of electrically conducting material is received in the larger diameter portion of the hollow and locked against displacement relative to the socket body. An insulating plate having a foot contact thereon is mounted within the ferrule for axial displacement within limits. Closely engaged in the smaller diameter portion of the socket body hollow, on the other hand, is a cylindrical packing of elastic material for watertightly closing the rear end of the hollow, the packing including a flange on a front end thereof which is held against the annular shoulder of the socket body. A spring is disposed between the insulating plate and the packing so as to be yieldable to allow rearward displacement of the insulating plate relative to the ferrule, the spring being further effective to force the flange of the packing against the annular shoulder of the socket body for the establishment of watertight engagement therebetween.

The spring itself is a standard component of this type of socket structures. In the present invention, however, the spring serves the additional purpose of forcing the flange of the packing into direct, watertight contact with the annular shoulder of the socket body. Thus firmly engaged with the socket body under pressure, the packing requires no such additional means as the sealant employed conventionally, for waterproofing the socket. The assemblage of the socket in accordance with the invention is therefore much easiser than heretofore.

As an additional advantage of the socket construction summarized above, the ferrule need not be engaged with the packing and so can be in the shape of a plain hollow cylinder. The packing can also be materially simplified in shape, being typically in the shape of a flanged cylinder. These simple shapes of the ferrule and packing, combined with the ease of their mounting in place on the socket body, also contribute to the ease of the assemblage of the socket and to the reduction of its manufacturing cost.

The above and other features and advantages of this invention and the manner of realizing them will become more apparent, and the invention itself will best be understood, from a study of the following description and appended claims, with reference had to the attached drawings showing a preferred embodiment of the invention.

DESCRIPTION OF THE PREFERRED EMBODIMENT

Figure 1:
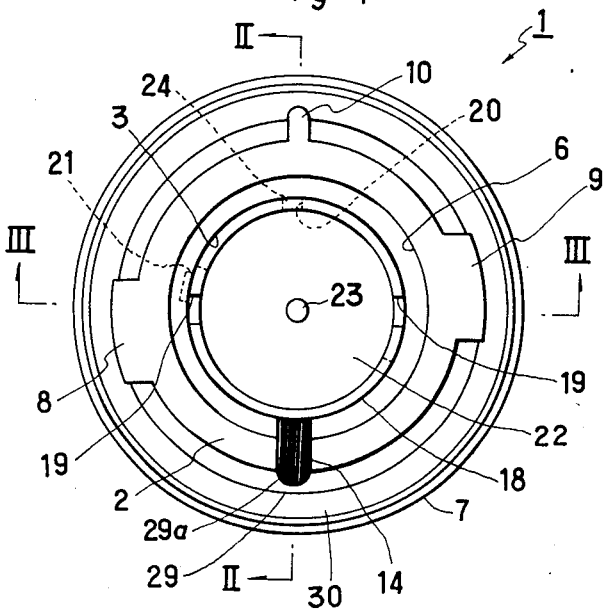
FIG. 1 is a front end elevation of the waterproof socket structure constructed in accordance with the novel concepts of the present invention.

The waterproof socket structure in accordance with the invention will now be described in detail as adaptaed for bayonet engagement with a lamp base (not shown). Generally designated 1 in FIGS. 1 through 4, the socket structure comprises a socket body 2 of one piece plastic molding. The socket body 2 has a hollow 3 formed axially therethrough. The diameter of the hollow 3 is reduced in two steps as it extends rearwardly from the front end, directed to the left in FIG. 2, of the socket body 2 to provide two annular shoulders 4 and 5 internally of the socket body in the vicinity of its rear end. Both annular inside shoulders 4 and 5 are directed forwardly of the socket body 2. The diameter of the hollow 3 should be gradually reduced in diameter as it extends rearwardly from the rear shoulder 5, for the desired watertightness of the socket structure 1, as will be better understood as the description proceeds.

Figure 2:
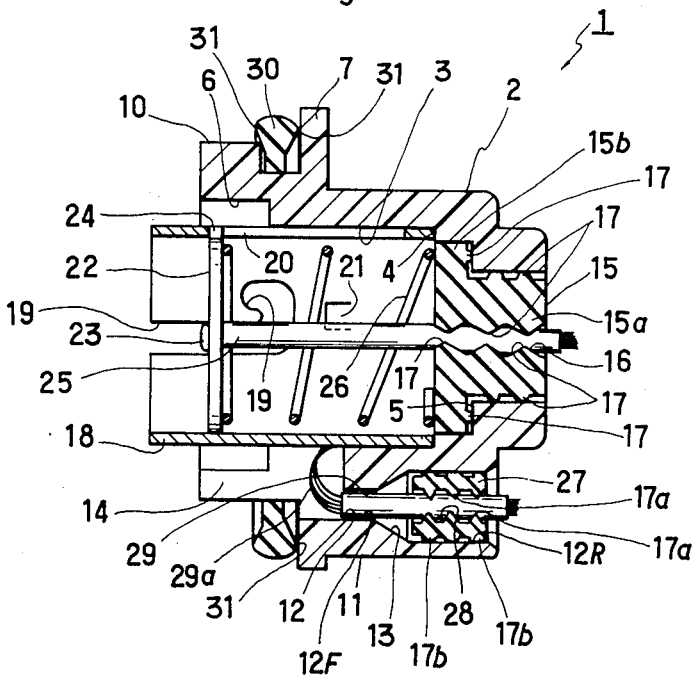
FIG. 2 is an axial section through the socket structure, taken along the line II—II in FIG. 1.
Figure 3:
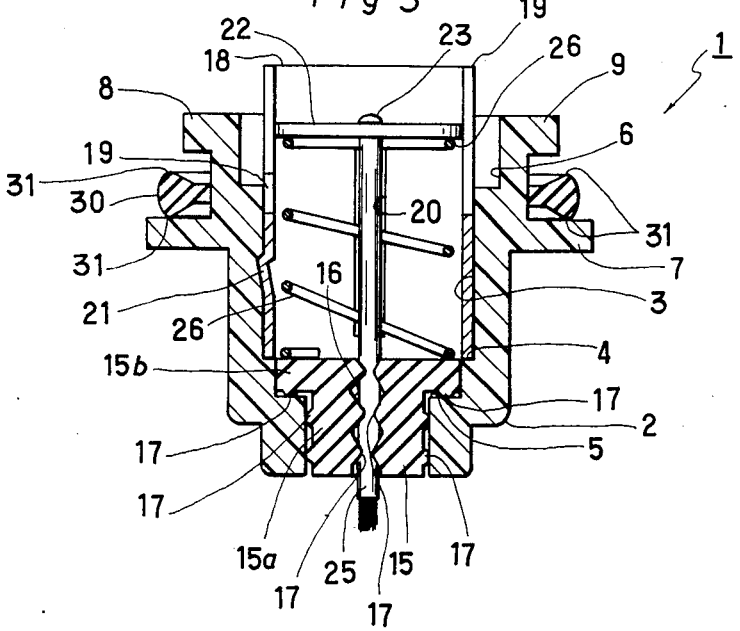
FIG. 3 is also an axial section through the same socket structure, taken, however, along the line III—III in FIG. 1 which is angularly displaced 90 degrees from the line II'II.

As best seen in FIGS. 2 and 3, the socket body 2 has an increased diameter portion 6 at its front end, and a flange 7 is formed on the rear end of this increased diameter portion. The increased diameter portion 6 is provided with a pair of lugs 8 and 9 extending radially outwardly from its front end, with the lugs being angularly spaced approximately 180 degrees from each other. This pair of lugs 8 and 9 coacts with the flange 7 to engage therebetween the annular edge of the associated lamp body, not shown, defining a mounting hole centrally therein, the lamp body being a part of the automotive lamp assembly of which the socket structure 1 also forms a part. The increased diameter portion 6 is further provided with a stop 10 engageable with the lamp body to limit the rotation of the socket body 2 with respect to the lamp body.

Figure 4:
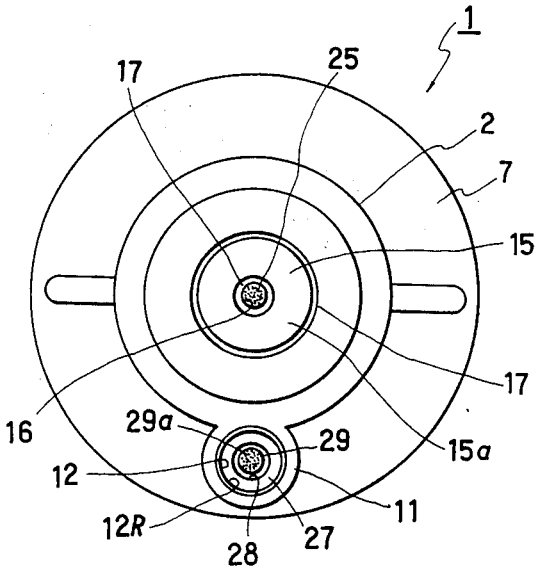
FIG. 4 is a rear end elevation of the same socket structure.

FIGS. 2 and 4 indicate that the socket body 2 is molded integral with a cylindrical appendage 11 extending rearwardly and parallel to the socket body axis from the flange 7. The appendage 11 has a hollow 12 extending axially therethrough and further through the flange 7. This hollow 12 has a smaller diameter front portion 12F, a larger diameter rear portion 12R, and a frustoconical connective portion 13 therebetween. The smaller diameter front portion 12F is open to a recess 14, FIGS. 1 and 2, cut in the larger diameter portion 6 of the socket body 2.

Watertightly closing the rear end of the socket body 2 is a packing 15 of rubber or like elastic material seen in FIGS. 2 through 4. The packing 15 has a cylindrical major portion **15*a* engaged in the smallest diameter rear end portion of the hollow 3 in the socket body 2, and a flange 15*b* formed on the front end of the major portion and received in the intermediate diameter portion of the hollow 3 which is between the two annular shoulders 4 and 5. A hole 16 extends axially through the packing 15. It will also be noted from FIGS. 2 and 3 that the packing 15 has annular ribs 17 on the outer surface of its major portion 15*a*, on the rear surface of the flange 15*b*, and on its inside surface bounding the hole 16. The major portion 15*a* is shown to have two such ribs on its outer surface and three such ribs on its inside surface, whereas the flange 15*b* is shown to have but one such rib on its rear surface, all by way of example only. The ribs 17 on the outer surface of the major packing portion 15*a* are watertightly held against the surface of the packing body 2 defining the smallest diameter portion of the hollow 3. The rib 17 on the packing flange 15*b* is held against the rear inside shoulder 5 of the socket body 2**.

A tubular, metal ferrule 18 is closely received in the largest diameter front portion of the hollow 3 in the socket body 2, with its rear end abutting on the front inside shoulder 4 of the socket body. As best seen in FIG. 3, a wedge shaped protuberance 21 on the ferrule 18 is embedded in the inside surface of the socket body 2 to lock the ferrule against displacement relative to the socket body. The ferrule 18 has a pair of J shaped lock slots 19 formed in diametrically opposed positions thereon for locking engagement with pins on the bayonet base of the unshown lamp. The ferrule 18 further has a guide slot 20 extending axially and terminating short of its opposite axial ends.

Made of Bakelite (trademark) or like material, an insulating plate or disk 22 is slidably fitted in the ferrule 18, with a guide lug 24 on the insulating plate slidably engaged in the guide slot 20 in the ferrule for guiding the axial travel of the insulating plate, and preventing the rotary displacement thereof, with respect to the ferrule. The insulating plate 22 has a foot contact 23 disposed centrally thereon. The foot contact 23 is electrically connected to a feed cable 25 extending rearwardly from the insulating plate 22 through the axial hole 16 in the packing 15. The annular ribs 17 on the packing 15 firmly engage the feed cable 25 as the latter is inserted into and through the hole 16, for watertightly sealing the joint between packing 15 and cable 25.

A helical compression spring 26 extends between packing 15 and insulating plate 22 for normally holding the latter in the extreme forward position depicted in FIGS. 2 and 3. The spring 26 yields to permit rearward displacement of the insulating plate 22 relative to the ferrule 18 upon engagement of the bayonet base of the unshown lamp with the socket structure 1. By so yielding, the spring 26 exerts pressure on the insulating plate 22 in order to maintain the foot contact 23 in positive electrical engagement with the metal plate on the lamp base.

Further the force of the spring 26 is applied rearwardly to the packing 15 to urge the rib 17 on its flange **15*b* against the rear inside shoulder 5 of the socket body 2 for the establishment of watertight contact therebetween. As has been stated, the hollow 3 in the socket body 2 is gradually reduced in diameter as it extends rearwardly from the rar inside shoulder 5. Consequently, upon exertion of the rearward force on the packing 15 by the spring 26, the main body 15*a* of the packing becomes displaced further rearwardly, causing the ribs 17 thereon to be pressed harder against the inside surface of the socket body 2 defining the tapering rear end portion of the hollow 3. It will be appreciated that the watertight contact between socket body 2 and packing 15 becomes all the more complete as the spring 26 becomes compressed upon engagement of the socket structure 1** with the lamp base.

Another packing 27 is pressfitted in the larger diameter rear portion 12R of the hollow 12 in the cylindrical appendage 11 of the socket body 2. This packing 27 also has a plurality of annular ribs **17*a* on its inner surface defining a hollow 28 and a plurality of annular ribs 17*b* on its outer surface. The outer ribs 17*b* make watertight engagement with the inner surface of the appendage 11. The inner ribs 17*a* make watertight engagement with a grounding cable 29 extending through the hollow 28**.

The grounding cable 29 further extends through the smaller diameter front portion 12F of the hollow 12. The bared wires 29*a* of this cable 29 further extend thorugh the recess 14 in the larger diameter portion 6 of the socket body 2 and are caught between socket body 2 and ferrule 18 in electrical contact with the latter. Thus, as the lamp is mounted to this socket structure 1, an electric circuit is completed which comprises the feed cable 25, foot contact 23, support wires and filament of the lamp, lamp base, ferrule 18, and grounding cable 29.

At 30 in FIGS. 1 through 3 is shown an annular gasket mounted on the enlargement diameter portion 6 of the socket body 2 by being caught between the lugs 8 and 9 and the flange 7. The gasket 30 is sectorial in cross sectional shape, having a pair of opposite ridges 31 to be held fast against the flange 7 and the unshown lamp body of the lamp assembly for watertightly sealing the joint therebetween. Despite the high sealing capability, this gasket 30 is of exactly symmetrical construction as seen cross sectionally as in FIGS. 2 and 3, so that it can be mounted on the socket body 2 with either of its sides oriented in either direction, thus facilitating the assemblage of the lamp assembly.

It is to be understood that the preferred embodiment disclosed herein is by way of example only and is not intended to impose limitations on the present invention, reference being had for this purpose to the claims which follow.

What is claimed is:

1. A waterproof lamp socket construction, comprising in combination:

a socket body having a hollow extending axially therethrough, the hollow including a large diameter portion extending rearwardly from a front end of the socket body and a smaller diameter portion adjacent a rear end of the socket body thereby to define between the larger and smaller diameter portions an annular step portion which faces toward said front end of the socket body;

a tubular ferrule of electrically conducting material received in the larger diameter portion of the hollow in the socket body, said tubular ferrule including a wedge shaped protuberance which is embedded in the inside surface of the socket body thereby to lock the tubular ferrule against displacement relative to the socket body;

an insulating plate having a foot contact thereon and mounted within the ferrule for axial displacement within limits;

a cylindrical packing of elastic material intimately plugged into the smaller diameter portion of the hollow in the socket body for watertightly sealing the rear end of the hollow, the packing including a flange on a front end thereof and a first annular rib formed on a rear surface of said flange, said first annular rib being intimately held against said annular step portion of the socket body, said packing further including second annular ribs about a major portion thereof and pressed against the wall of the smaller diameter portion of the hollow of the socket body, said first and second annular ribs being arranged to constitute a labyrinth seal;

a spring compressed between the insulating plate and the flange of the packing thereby to bias said insulating plate and said flange in opposite directions thereby pressing said annular rib against said annular step portion; and an annular gasket disposed about the socket body, said gasket having a pair of opposite ridges one of which is fast held against a flange formed about the socket body.

2. The watertight lamp socket construction as recited in claim 1, wherein the smaller diameter porion of the hollow in the socket body is gradually reduced in diameter as it extends rearwardly, whereby the packing on being forced rearwardly by the spring makes more watertight contact with the inside surface of the socket body bounding the smaller diameter portion of the hollow.

3. The watertight lamp socket construction as recited in claim 1, wherein the hollow in the socket body is adapted to provide a second annular shoulder located forwardly of the first mentioned shoulder, and wherein the ferrule is held endwise against the second shoulder.

4. The watertight lamp socket construction as recited in claim 1, further including a cable extending into the socket body through an axial hole in the packing into electrical engagement with the foot contact on the insulating plate, the packing having on its inside surface defining the axial hole a plurality of annular ribs for watertight engagement with the cable.

* * * * *